US005481768A

United States Patent [19]

Shink

[11] Patent Number: 5,481,768

[45] Date of Patent: Jan. 9, 1996

[54] EASILY STORED PILLOW AND BLANKET AND METHOD

[75] Inventor: Joseph M. Shink, Valencia, Calif.

[73] Assignee: Auto-Shade, Inc., Moorpark, Calif.

[21] Appl. No.: 244,955

[22] PCT Filed: Oct. 14, 1992

[86] PCT No.: PCT/US92/06774

§ 371 Date: Aug. 8, 1994

§ 102(e) Date: Aug. 8, 1994

[87] PCT Pub. No.: WO94/08497

PCT Pub. Date: Apr. 23, 1994

[51] Int. Cl.[6] ..... A47G 9/00; A47G 9/04

[52] U.S. Cl. ..... 5/482; 5/420; 5/636; 297/397

[58] Field of Search ..... 5/417–420, 482, 5/636, 640–502; 297/391, 397; 29/91, 91.1; 190/1, 2; 383/4

[56] References Cited

U.S. PATENT DOCUMENTS

| | | | |
|---|---|---|---|
| 2,344,010 | 3/1944 | Walsh | 2/69 |
| 3,477,552 | 11/1969 | Goldman | 5/417 |
| 4,468,810 | 8/1984 | Longo | 5/417 |
| 5,048,975 | 9/1991 | Holbrook | 5/417 |
| 5,088,139 | 2/1992 | Bloom | 5/420 |

FOREIGN PATENT DOCUMENTS

| | | | |
|---|---|---|---|
| 819449 | 10/1951 | Germany | 5/417 |

*Primary Examiner*—Alexander Grosz
*Attorney, Agent, or Firm*—Blakely Sokoloff Taylor & Zafman

[57] ABSTRACT

A blanket that can be converted into a pillow. The blanket has a pair of straps which can secure the blanket in a folded position.

2 Claims, 3 Drawing Sheets

FIG. 2
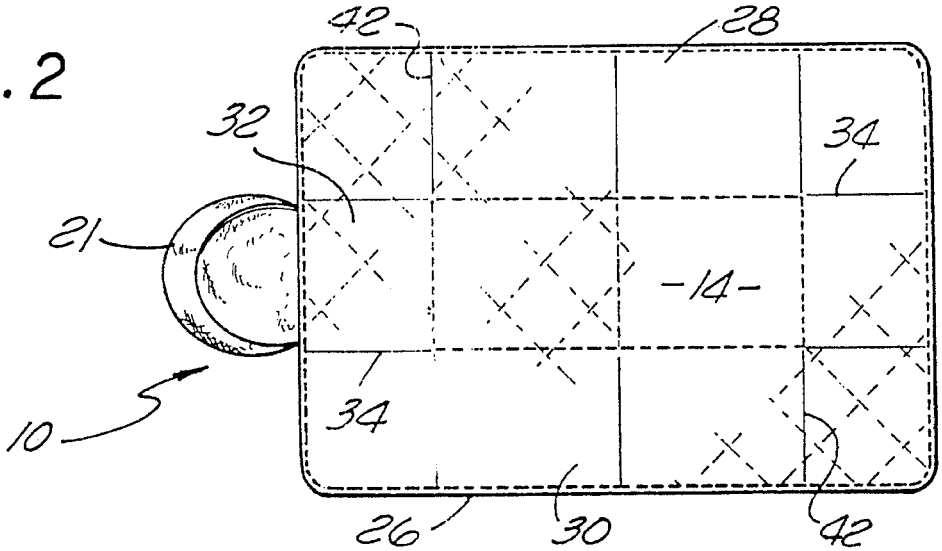
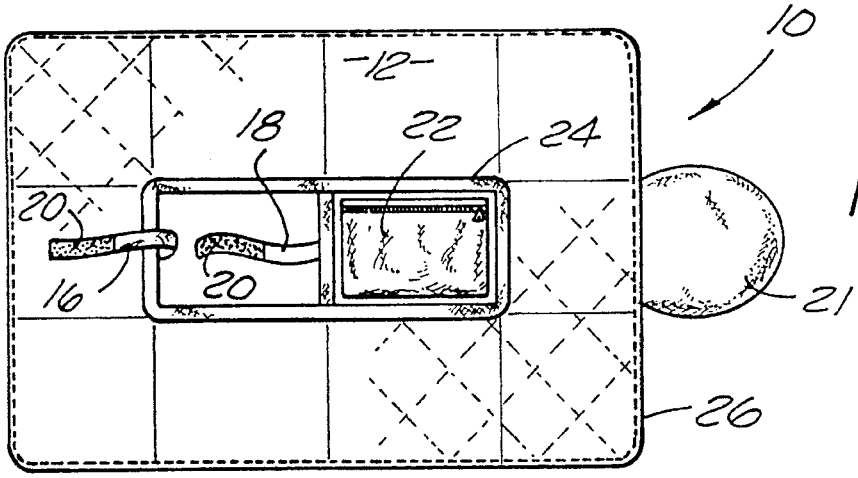
FIG. 1
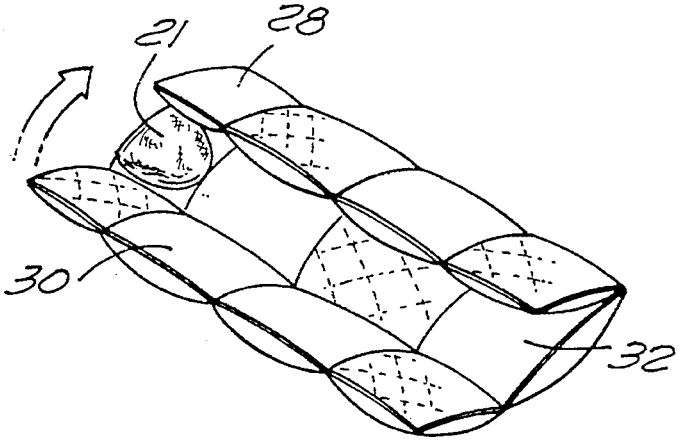
FIG. 3

FIG. 4
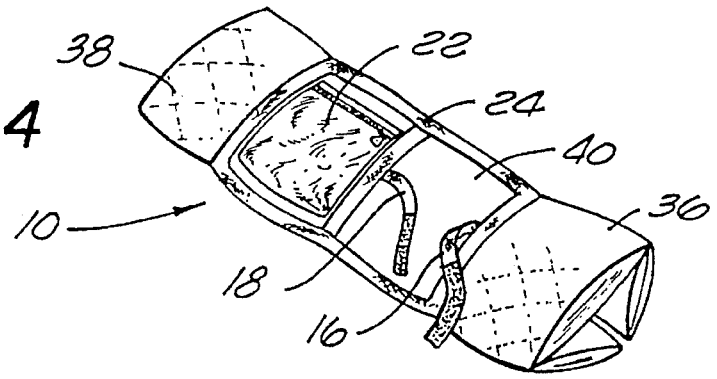
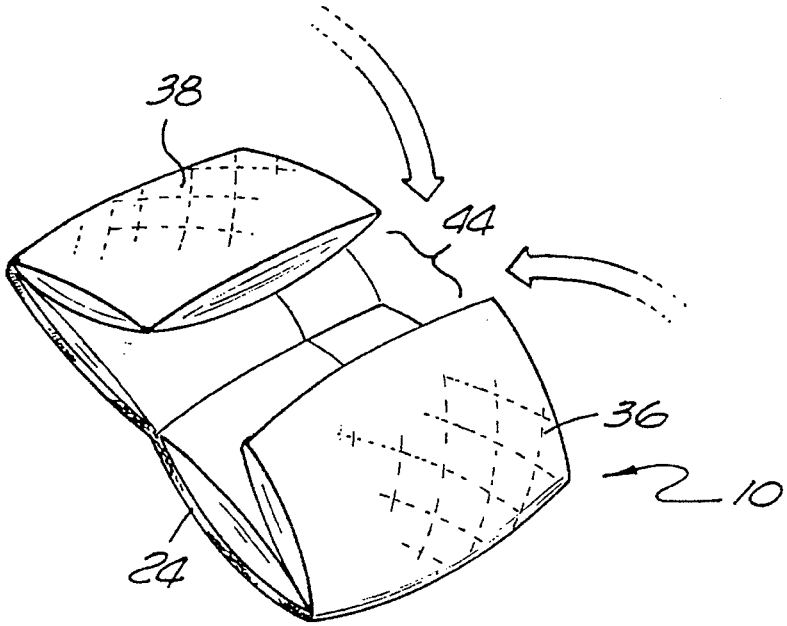
FIG. 5
FIG. 6
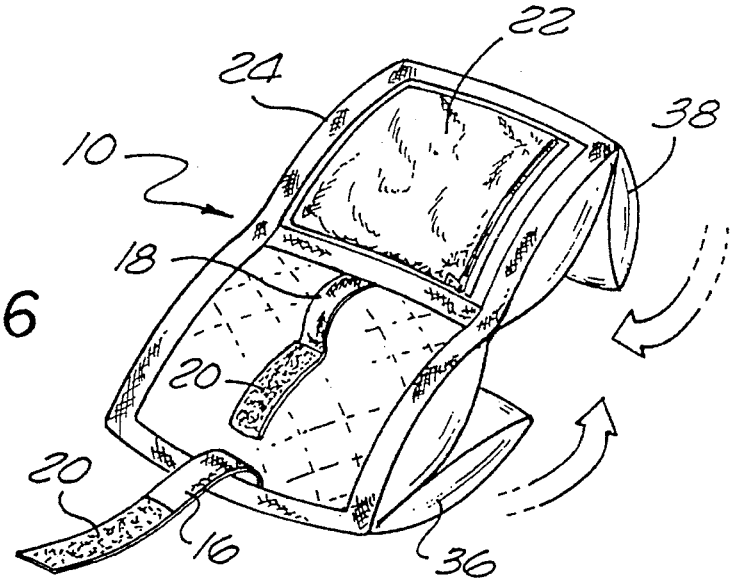

EASILY STORED PILLOW AND BLANKET AND METHOD

BACKGROUND OF THE INVENTION

1. Field of the Invention

The present invention relates to a blanket that can be converted into a pillow.

2. Description of Related Art

Traveling long distances in a plane or car can be quite tiresome. Consequently, some passengers sleep or rest during the trip. Pillows and blankets are used to increase the comfort of the journey. In fact, most commercial airlines provide blankets and pillows in the storage compartments of the passenger cabin. Additionally, it is quite common for the occupants of an automobile to bring pillows and blankets on a long trip.

Bringing both a pillow and a blanket can decrease the occupancy space of an automobile. Such additional luggage can be undesirable, particularly for a fully occupied car. Although a blanket can be folded into a pillow, blankets of the prior art are difficult to position and can become unfolded. U.S. Pat. No. 2,183,418 issued to Williams and British Patent No. 688,307 issued to Armstrong disclose blankets which can be folded into a pillow. The folded blanket sections can be inserted into pockets incorporated into the blankets. The pockets require additional stitching and material, and are therefore more expensive to assembly and produce. The incorporation of pockets also requires the user to fold the blanket small enough to fit within the inner cavity of the pockets. Such a procedure may result in several folding cycles to obtain a folded blanket of the proper size. It would therefore be desirable to have a relatively inexpensive blanket that can be converted into a pillow without using pockets. It would also be desirable to have a convertible pillow which can be attached to the seat of a car.

SUMMARY OF THE INVENTION

The present invention is a blanket that can be converted into a pillow. The blanket includes a sheet of fabric that has a first surface and a second opposite surface. The blanket has a pair of straps extending from the first surface which can secure the blanket in a folded position.

In the unfolded position, the fabric sheet is defined by a first longitudinal strip that is separated from a second longitudinal strip by a center longitudinal strip. To fold the blanket into a pillow, the user folds the first longitudinal strip onto the center longitudinal strip and then folds the second longitudinal strip onto the first longitudinal strip. The folds occur on the second surface of the fabric sheet, opposite the straps.

The folded longitudinal strips form an intermediate pillow with a first side portion separated from a second side portion by a center portion that has a centerline. The first and second side portions are folded onto the center portion in a direction away from the straps. The center portion is then folded about the centerline so that the first side portion is adjacent to the second side portion.

The straps are then wrapped around the pillow and attached together to secure the blanket in the folded position. The straps prevent the blanket from becoming inadvertently unfolded during storage or use. The straps can also be wrapped around the seat of an automobile to provide an additional pillow for the seat.

Therefore it is an object of the present invention to provide a blanket that can be easily converted into a pillow.

It is also an object of the present invention to provide a blanket that can be converted into a pillow and attached to the seat of a car.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a top view of a blanket of the present invention;

FIG. 2 is a bottom view of the blanket of FIG. 1;

FIG. 3 is a perspective view showing the sides of the blanket being folded onto a center portion;

FIG. 4 is a bottom view of the folded blanket of FIG. 3;

FIG. 5 is a perspective view showing the ends of the blanket folded onto the center portion;

FIG. 6 is a bottom view of the folded blanket of FIG. 5;

DETAILED DESCRIPTION OF THE INVENTION

Figure 7:
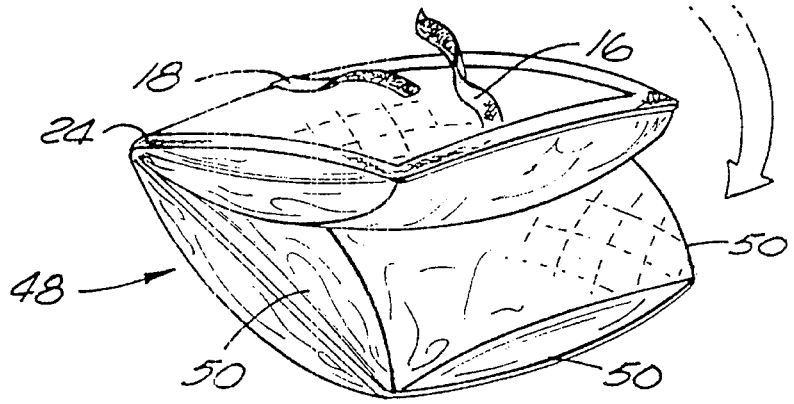
FIG. 7 is a perspective view of the blanket showing the folded center portion folded in half.

Referring to the drawings more particularly by reference numbers, FIGS. 1 and 2 shows a blanket 10 of the present invention. The blanket is typically constructed from sheets of fabric that are stitched together by means well known in the art. In the preferred embodiment, the fabric is a soft blend of polyester and cotton that is easy to wash and clean. The fabric may encapsulate a soft cushion that increases the softness and the thermal resistance of the blanket. In the preferred embodiment, the cushion is constructed from a feather filling or a polyester fiber. The fabric may have different colors or patterns to improve the overall appearance of the blanket. The blanket may also come in a variety of sizes. In the preferred embodiment, the blanket is constructed into one of two sizes. The larger size blanket is constructed so that the blanket can be folded into a pillow big enough to use as a seat cushion. The smaller size blanket is constructed so that the blanket can be folded into a pillow that is slightly larger than the user's head.

The blanket 10 has a first surface 12 and a second surface 14. Attached to the first surface 12 is a first strap 16 and a second strap 18. The straps 16 and 18 typically have hook and loop material 20 which allow the straps to be easily connected and detached. Although hook and loop material 20 is described and shown, it is to be understood that the straps may be attached by other means such as a buckle. The blanket may also have a head bonnet 21 which is typically constructed to be worn on a babies head. The head bonnet 21 can be constructed to be removed from the blanket by attaching the bonnet to the blanket with hook and loop material. The first surface 12 of the blanket may also have a zippered pocket 22 adapted to store items inserted by the user. An additional fabric strip 24 can also be sewn into the fabric to improve the appearance of the pillow. The blanket 10 typically has a fringe 26 sewn into the outer edges of the fabric.

FIGS. 2–7 show a preferred method of folding the blanket 10 into a pillow. As shown in FIG. 2, the blanket 10 is turned over to expose the second surface 14. The blanket 10 is defined by a first longitudinal portion 28 that is separated from a second longitudinal portion 30 by a center longitudinal portion 32. The longitudinal portions are typically defined by creases 34 that extend along the length of the blanket.

As shown in FIG. 3, the first longitudinal portion 28 is folded onto the center longitudinal portion 32, so that the second surfaces of each portion are adjacent to each other. The second longitudinal portion 30 is then folded on top of the first longitudinal portion 28, so that the second surface of the second portion 30 is adjacent to the first surface of the first portion 28. The head bonnet 21 is typically folded into the center portion 32 before the longitudinal portions 28 and 30 are folded.

As shown in FIGS. 4, the folded longitudinal portions create an intermediate blanket that has a first side portion 36 separated from a second side portion 38 by a center portion 40. As shown in FIG. 1, The side portions are typically defined by creases 42 that extend along the width of the blanket 10.

As shown in FIGS. 5 and 6, the first 36 and second 38 side portions are folded onto the center portion 40. The side portions are separated by a gap 44 and a centerline. The spacing of the gap 44 is such that the blanket can be folded about the centerline.

Figure 8:
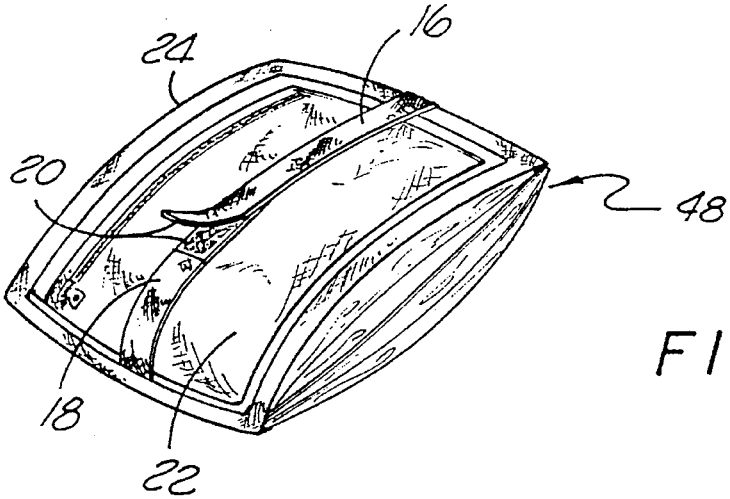
FIG. 8 is a perspective view similar to FIG. 7 showing a zipper securing the outer edges of the pillow.

As shown in FIG. 7 the blanket is then folded about the centerline to create a pillow 48 with three unattached outer edges 50. As shown in FIG. 8, the straps 16 and 18 are wrapped around the pillow 48 and attached together by pressing into contact the hook and loop material 20. The straps 16 and 18 secure the pillow 48 in the folded position. The pillow 48 can be converted back into the blanket 10, by detaching the straps 16 and 18, and unfolding the pillow 48.

Figure 9:
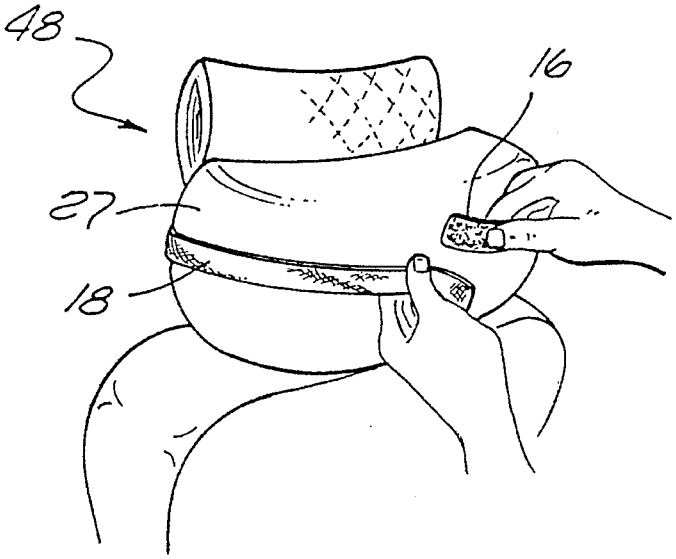
FIG. 9 is a perspective view of a pillow with a pair of straps that allow the pillow to be secured to a car seat.

As shown in FIG. 9, the straps 16 and 18 can be wrapped around the head rest of a car, to secure the pillow to the seat. Although the present invention is shown and described as being attached to a car seat, it is to be understood that the pillow can be connected to other objects such as the headrest of a chair. The blanket may also have another strap (not shown) sewn into the fabric to form a handle that allows the user to easily carry the pillow.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method of converting a blanket into a pillow, comprising the steps of:

a) providing a fabric sheet with a first surface and a second surface and a pair of straps attached to said first surface, said fabric sheet being defined by a first longitudinal portion separated from a second longitudinal portion by a center longitudinal portion;

b) folding said second surface of said first longitudinal portion onto said second surface of said center longitudinal portion;

c) folding said second surface of said second longitudinal portion onto said first surface of said first longitudinal portion, such that there is created an intermediate fabric sheet being defined by a first side portion separated from a second side portion by a center portion that has a centerline;

d) folding said first side portion onto said center portion;

e) folding said second side portion onto said center portion;

f) folding said center portion about said centerline such that said first side portion is adjacent to said second side portion, wherein there is defined a pillow with three unattached edges;

g) wrapping said straps around said pillow; and, h) attaching said straps together to secure said three unattached edges of said pillow.

2. The method as recited in claim 1, wherein said straps are wrapped around a car seat to attach said pillow to said car seat.

* * * * *